United States Patent [19]

Sawyer

[11] Patent Number: 4,712,604

[45] Date of Patent: Dec. 15, 1987

[54] APPARATUS FOR CASTING DIRECTIONALLY SOLIDIFIED ARTICLES

[75] Inventor: Thomas F. Sawyer, Charlton, N.Y.

[73] Assignee: The United States of America as represented by the Secretary of the Air Force, Washington, D.C.

[21] Appl. No.: 917,934

[22] Filed: Oct. 14, 1986

[51] Int. Cl.[4] ..... B22D 27/04

[52] U.S. Cl. ..... 164/513; 164/338.1; 164/122.1

[58] Field of Search ..... 164/122.1, 122.2, 127, 164/361, 348, 338.1, 513

[56] References Cited

U.S. PATENT DOCUMENTS 3,260,505 7/1966 Ver Snyder .
3,366,362 1/1968 Chandley et al. .
3,494,709 2/1970 Piearcey .
3,790,303 2/1974 Endres .
3,793,012 2/1974 Walter et al. .
3,810,504 5/1974 Piwonka .
3,942,581 3/1976 Sawyer .

FOREIGN PATENT DOCUMENTS 57-1564 1/1982 Japan ..... 164/122.1

OTHER PUBLICATIONS

"The Superalloys", Edited by C. T. Sims et al, John Wiley and Sons, 1972, pp. 479–508.
Product Note Published by Babcock & Wilcox entitled Kaowool Ceramic Fiber Products, SAFFIL Alumina Blanket (9–76).

*Primary Examiner*—Kuang Y. Lin
*Attorney, Agent, or Firm*—Richard J. Donahue; Donald J. Singer

[57] ABSTRACT

A furnace assembly for casting directionally solidified articles, such as turbine blades. A pair of tunnels feed blanket insulative material towards the bottom of the heating chamber to engulf the mold as it exits the chamber atop a water cooled pull rod.

8 Claims, 3 Drawing Figures

APPARATUS FOR CASTING DIRECTIONALLY SOLIDIFIED ARTICLES

STATEMENT OF GOVERNMENT INTEREST

The invention described herein may be manufactured and used by or for the Government for governmental purposes without the payment of any royalty thereon.

BACKGROUND OF THE INVENTION

The present invention concerns apparatus for casting directionally solidified articles from a eutectic superalloy composition.

Superalloys are heat resistant materials having superior strength and oxidation resistance at high temperatures. Many of these alloys contain iron, nickel or cobalt alone or in combination as the principal element, together with chromium to impart surface stability and usually containing only one or more minor constituents such as molybdenum, tungsten, columbium, titanium and aluminum for the purpose of effecting strengthening. The physical properties of the superalloys make them particularly useful in the manufacture of gas turbine components.

The strength of superalloys is determined in part by their grain size. At low temperatures fine-grain equiaxed structures are preferred. At high temperatures large-grain size structures are usually found to be stronger than fine-grain size structures. It is believed that failure generally originates at grain boundaries oriented perpendicular to the direction of the induced stress.

An improved techniques for casting superalloys used in gas turbine engines is disclosed by F. L. Ver Snyder in U.S. Pat. No. 3,260,505, wherein a blade is formed having an elongated columnar structure with unidirectional crystals aligned substantially parallel to the long axis of the blade. This procedure involves directional solidification whereby almost a complete elimination of grain boundaries normal to the primary stress axis occurs. A further advance was made by B. J. Piearcy, as disclosed in U.S. Pat. No. 3,494,709 wherein grain boundaries in superalloys were eliminated by making single crystal castings.

Directional solidification to provide columnar casting and the apparatus used for this purpose are described on pages 479–508 in the text entitled The Superalloys, edited by C. T. Sims et al and published by John Wiley & Sons in 1972. Columnar grains are formed when the melt temperature is greater than the freezing temperature and when the flow of heat is unidirectional from the liquid through the solid. Typically, a ceramic investment casting mold is attached to a water-cooled copper chill plate and placed in an induction-heated graphite susceptor. The mold is heated above the melting point of the alloy being cast and the superheated melt is poured into the mold. Heat enters the upper portion of the mold by radiation from the susceptor and is removed through the solidified metal by the chill at the bottom. Thus, solidification occurs in an upward direction through the casting, and the rate of solidification is a function of the amount of heat entering at the top of the casting and the amount of heat extracted from the casting through the solid.

In the Stockbarger method described in the aforementioned text, the furnace heat-flow configuration requires a sharp temperature difference between the lower and upper furnace portions which is provided by a baffle at the bottom of the furnace. The mold is gradually withdrawn through the baffle so that the solid-liquid interface remains essentially parallel with the plane of the baffle.

The Bridgman-type apparatus has been used to produce acceptable elongated grain structures of numerous superalloys. Here the susceptor is heated inductively, which melts the charge in the crucible. After equilibrium is established, the mold assembly is lowered out of the heat zone and nucleation of solid occurs in the bottom of the crucible. Directional freezing continues upward as the mold unit is lowered.

Walter et al, in U.S. Pat. No. 3,793,012, discloses the preparation of unidirectionally solidified nickel-base carbide reinforced cast superalloy bodies having high strength and high stress-rupture properties, particularly at elevated temperatures. The reinforced fibers present in the matrix were aligned single crystal fibers of metal monocarbides. When such castings are made in shell molds, as in the manufacture of turbine blades, the outer configuration of the shell is not symmetrical due to projections of the platform and dovetail sections, as well as the thinning and twisting of the shell to conform to the pattern of the airfoil section of the blade. Attempts to directionally solidify a blade using such an irregular shaped shell have proven very difficult due to the gap between the radiation baffle and the shell to allow clearance of the shell as it is being withdrawn from the heat zone.

Turbine blades as they are presently processed, possess acceptable fiber alignment throughout the length of the airfoil. However, as the solid-liquid interface approaches the vicinity of the blade root in the solidification process, a breakdown to cellular morphology occurs. One of the reasons for the breakdown is reported to be due to an uncontrolled varying solidification rate, even though the casting is lowered out of a hot furnace at a constant rate. This non-uniform growth rate is believed to be the result of a varying heat input and heat output of the casting since, as mentioned earlier, the mold varies in cross section and must pass through a constant cross section baffle. When the platform of a turbine blade casting enters the baffle, more heat is applied to the casting since the gap between the mold and baffle decreases, resulting in a slowdown of the advancing solid-liquid interface.

In U.S. Pat. No. 3,942,581 issued to T. F. Sawyer on Mar. 9, 1976 there is disclosed an improved apparatus for producing a directionally solidified article from a eutectic superalloy composition. The apparatus comprises a mold within a heating zone in which the bottom of the mold is attached to a chill plate. A retaining means for a ceramic insulation surrounds the heating zone and the lower portion of the mold, the retaining means being attached at its bottom to a chill plate; A hollow bubble type ceramic insulation is disposed in the retaining means and is in contact with the lower portion of the mold. Also disclosed is a means for lowering the mold out of the heating zone and to permit the insulation to form a continuous heat barrier around the portion of the mold descending out of the heating zone.

The Sawyer patent, supra, further discloses a method of using the apparatus to directionally solidify nickel-or-cobalt base superalloys by disposing a plurality of hollow ceramic bodies around the mold such that as the mold is lowered, the bodies conform to and form a contacting layer around the outside surface of the mold as it is exposed below the heating zone, whereby lateral heat transfer is prevented.

An undesireable feature of the device disclosed and claimed by the Sawyer patent supra, is that the hollow spherical ceramic insulation approaches the mold from a jacket surrounding the susceptor and therefore, the insulation takes a path adjacent the hot parts of the furnace. Sintering of the insulation material may occur at high temperatures if it is allowed to come into contact with the hot sections of the furnace. As a result, the insulation, may become a coherent mass instead of individual bubbles, be unable to flow and thereby fail to provide a radiation barrier about the mold as it is lowered out of the furnace. In addition, if the article to be cast has a high ridge, the individual insulative spheres may not abut the areas of the mold near the ridge.

OBJECT AND SUMMARY OF THE INVENTION

It is therefore the primary object of the present invention to provide an improved furnace assembly for producing directionally solidified articles from eutectic superalloy compositions.

The improved furnace assembly basically comprises a heating chamber of substantially cylindrical shape adapted to accept a mold. The bottom of the mold rests on a pull rod, and a susceptor of substantially cylindrical cross-section surrounds the mold and is spaced therefrom to permit a downward vertical movement of the mold. The exterior of the susceptor is surrounded by insulative material and an RF coil which inductively heats the susceptor. The pull rod provides a means for lowering the mold out of the heating zone and preferrably has a coolant fluid pumped therein to provide a chilling surface at the end of the pull rod in contact with the base of the mold.

Positioned immediately below the bottom of the heating chamber and surrounding the pull rod are a pair of diametrically opposed tunnels having plunger means at the distant ends thereof for forcing a blanket type alumina insulation material against the mold as it exits the bottom of the furnace. The blanket insulation envelops the mold and forms a continuous heat barrier around the the mold as it descends out of the heating chamber of the furnace assembly whereby lateral heat transfer is prevented.

BRIEF DESCRIPTION OF THE DRAWINGS

The invention will be more clearly understood from the following detailed description thereof when read in conjunction with the accompanying drawings in which.

DESCRIPTION OF THE PREFERRED EMBODIMENT

Figure 1:
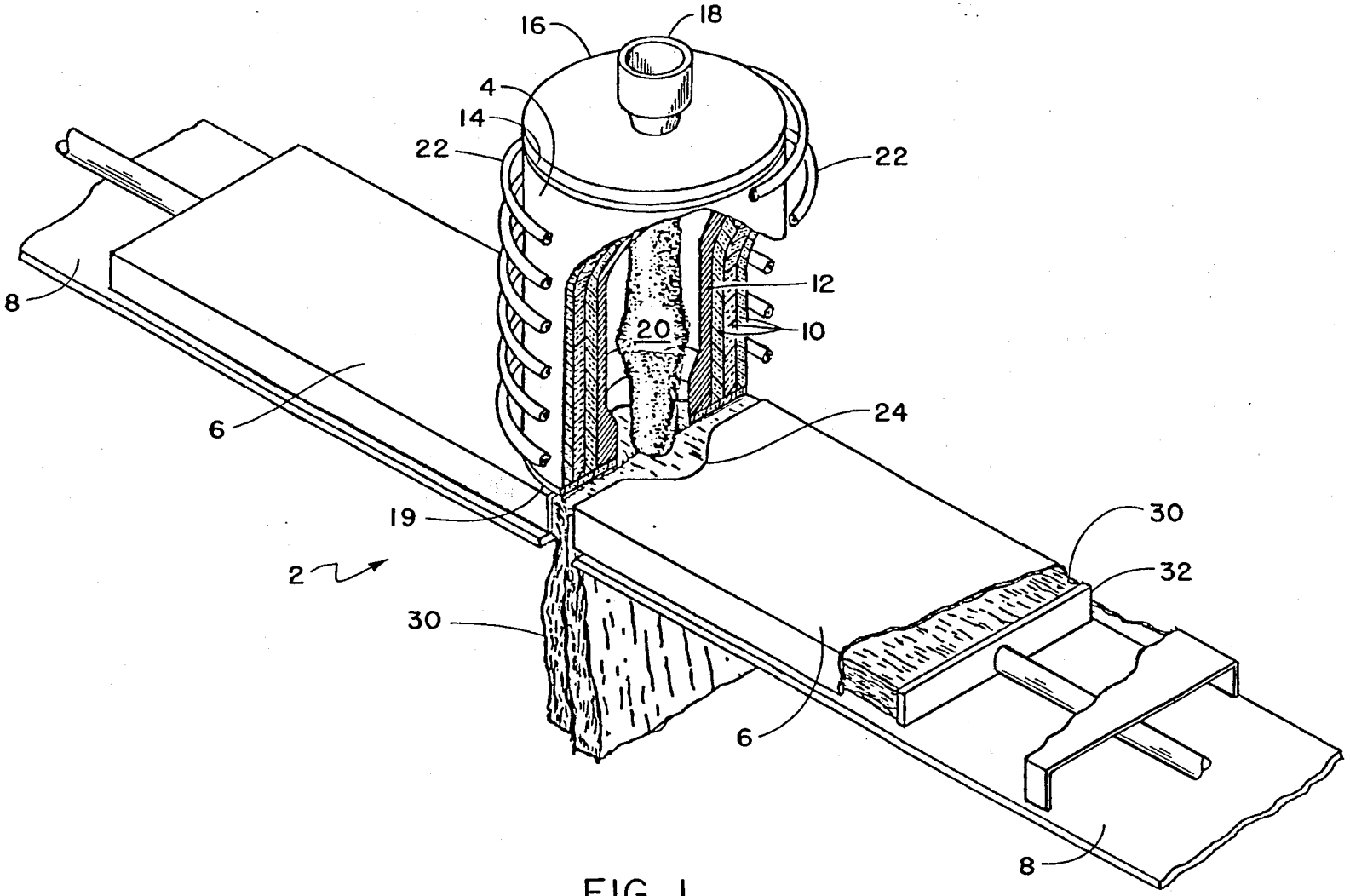
FIG. 1 is a partially-sectioned perspective sketch of the furnace assembly of the present invention.

In FIG. 1, reference numeral 2 indicates generally a furnace assembly in which a heating zone is established within a cylindrical heating chamber 4. Chamber 4 is positioned immediately above a pair of tunnels or tubes 6 supported by base plates 8. The purpose of the tunnels 6 will be described in great detail later herein.

Chamber 4 is formed of several layers of insulative material 10 which surround a graphite susceptor 12 and are held thereto by straps on ties 14. The top of chamber 4 is covered by an insulative disk-shaped cover 16 having an opening therein for receiving a pouring cup 18 while the bottom of chamber 4 is enclosed by an insulative cover 19 having a hole formed through the center thereof.

A ceramic shell mold 20 for producing a desired object, such as a turbine blade, is positioned within heating chamber 4. Generally, the mold 20 has a thickness of from about 0.10 to 0.25 inches or so, and is produced by well known techniques used for the manufacture of shell molds in precision investment castings. Mold 20 has an open ended cavity and riser into which molten metal is introduced via pouring cup 18. The interior of chamber 4 is heated to a high temperature by suitable means such as induction coil 22 although other heating means such as an electrical resistance heating element can be used.

It will be seen from FIG. 1 that an insulative blanket material 30 is contained within tunnels 6 and is urged towards the adjacent ends of tunnels 6 by plungers 32. Any suitable electromechanical or mechanical drive means, including spring biasing means, may be coupled to plungers 32 to cause the insulative blanket material 30 to move within tunnels 6. A sufficient gap is provided between the abutting ends of tunnels 6 to permit the blanket insulative material 30 to exit therefrom. In addition, tunnels 6 have curved portion 24 which together form a curved opening which conforms to the largest radial excursion of mold 20 and is of sufficient size to permit mold 20 to be withdrawn from the heating chamber 4.

Figure 2:
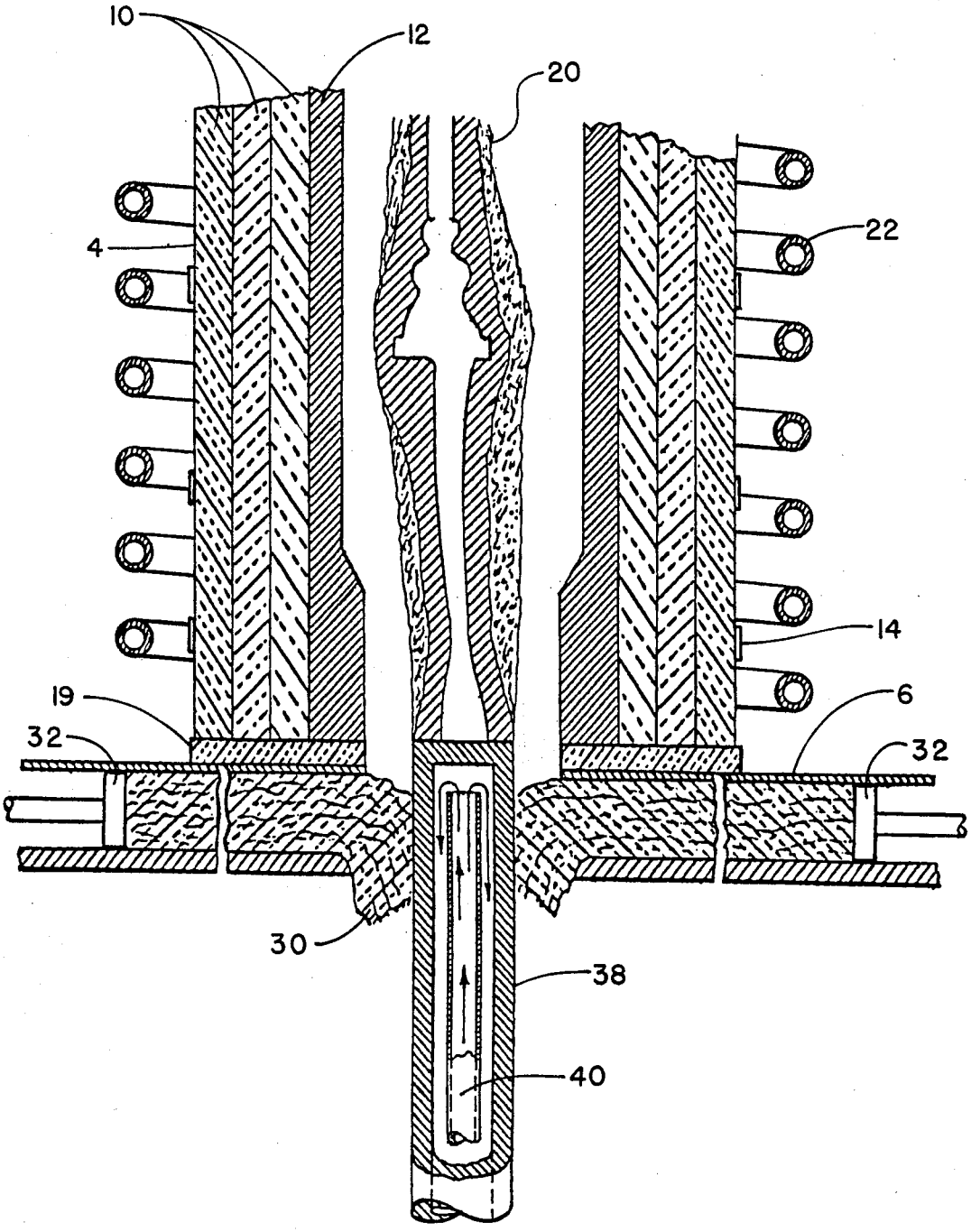
FIG. 2 is a partial cross-sectional view of the furnace assembly of the present invention as observed in the initial stage of the process for forming a directionally solidified turbine blade.

In FIG. 2, mold 20 is seen to be positioned on top of a water cooled pull rod 38, which may be lowered by mechanical or electromechanical means of conventional design and construction. The end of pull rod 38 adjacent mold 20 functions as a chill block for mold 20. Cooling water is introduced into the interior of pull rod 38 via tube 40 and the cooling water flows in the direction of the arrows shown within tube 40.

It is apparent from FIG. 2 that insulative blanket material 30 is pressed up against pull rod 38 and prevents heat from radiating from heating chamber 4. Further, that insulative blanket material 30 approaches the mold at right angles to and from below the heating chamber 4. As such it does not take a path adjacent the hot parts of the heating chamber 4, as is the case in the apparatus of the Sawyer patent, supra. Thus sintering of the insulative material at higher temperatures is avoided.

Insulative blanket material 30 is preferrably an alumina blanket fiber material. One such alumina blanket material is distributed by the Babcock and Wilcox Company under the name SAFFIL, a registered trademark of Imperial Chemicl Industries Limited for inorganic fiber. It is noteworthy that at 2400 degrees F., the SAFFIL blanket possesses an approximate four times insulation advantage over the alumina bubbles used in the prior art Sawyer device.

Figure 3:
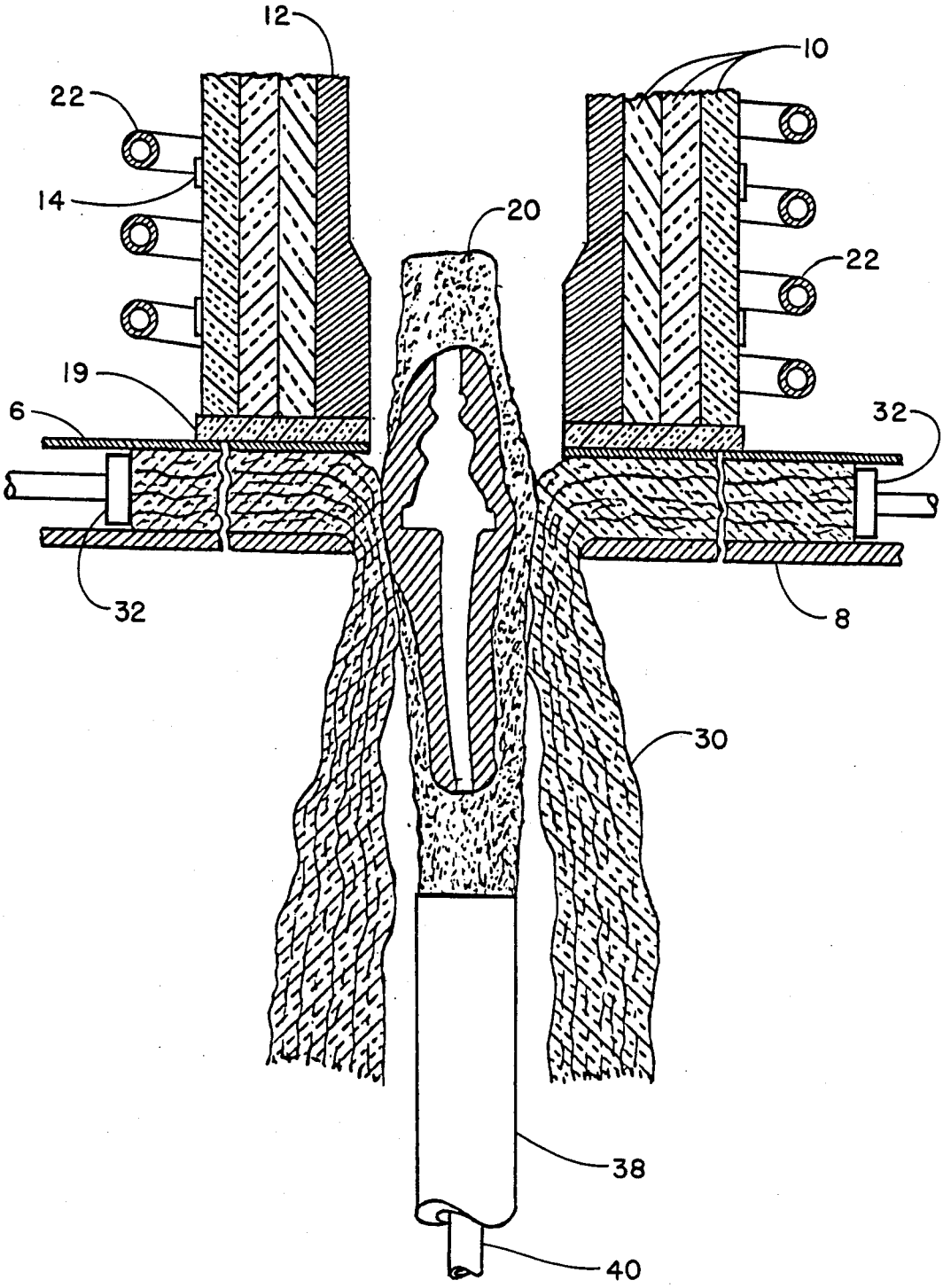
FIG. 3 is a partial cross-sectional view of the furnace assembly of the present invention after the mold for the turbine blade has been partially withdrawn from the furnace.

FIG. 3 illustrates a later stage in the process. As mold 20 is lowered by the downward motion of pull rod 38, there is also motion of the insulative blanket material 30 downward and about the surface of mold 20 at the critical area adjacent base plates 8 where mold 20 leaves the furnace assembly. An improved optical density is achieved since the insulation blanket material 30 completely engulfs mold 20. This may not occur in other systems if mold dimensions change drastically, as in the platform areas of turbine blades.

It will be appreciated that the invention is not limited to the specific details shown in the illustrations and that modifications may be made within the ordinary skill in the art without departing from the spirit and scope of the invention.

What is claimed is:

1. Apparatus for casting an article comprising:

heating chamber means for enveloping a mold and for establishing a heating zone thereabout;

mold support means for supporting said mold within said heating chamber means and for withdrawing said mold from said heating chamber means;

insulative material having its fibers arranged in a flexible blanket form; and tunnel means positioned below said heating chamber means, said tunnel means containing said insulative material and urging said material against said mold to cover said mold as it is extracted from said heating chamber means.

2. Apparatus as defined in claim 1 wherein said tunnel means comprise:

a pair of tubes of rectangular cross section, each of said pair of tubes having an end thereof adjacent said mold and plunger means disposed therein for forcing said insulative material against said mold.

3. Apparatus as defined in claim 2 wherein each of said pair of tubes has said end thereof adjacent said mold contoured to conform to the shape of the largest radial excursion of said mold.

4. Apparatus as defined in claim 3 wherein said mold support means comprises:

a metallic pull rod having a solid end surface forming a pedestal and chill surface for said mold.

5. Apparatus as defined in claim 4 wherein said pull rod has a cavity therein for containing a cooling fluid.

6. Apparatus as defined in claim 5 and further comprising:

a tube concentrically disposed within said pull rod for directing a cooling fluid towards said solid end surface of said pull rod.

7. Apparatus as defined in claim 6 wherein said heating chamber means comprises:

a substantially cylindrical graphite susceptor having insulation disposed thereabout, an induction coil encircling said susceptor, a first insulated disk having a pouring cup affixed therein and disposed on one end of said susceptor, and a second insulated disk disposed on the other end of said susceptor, said second disk having a hole therein to permit passage of said mold therethrough.

8. A furnace assembly for producing a directionally solidified article from a eutectic superalloy composition comprising: an insulated cylinder having a top and a bottom end cap, a cylindrical susceptor within said cylinder, and an induction coil surrounding said cylinder to produce a heated zone for a mold disposed within said susceptor, said top end cap having a pouring cup thereon for introducing an alloy to be directionally cast into said zone, said bottom end cap having an opening therein to permit removal of said mold from said cylinder; a metallic pull rod having a solid end surface for supporting said mold and for providing a chill surface for said mold, said pull rod having a cylindrical cavity therein and a tube within said cavity extending throughout the length of said cavity and spaced from the side and bottom surface walls of said cavity for coupling a coolant fluid through said pull rod, said pull rod being moveable to withdraw said mold from said cylinder; insulative material having alumina fibers arranged in a flexible blanket form; and first and second tunnels of rectangular cross section positioned immediately below said bottom end cap of said cylinder and containing said insulative material; said first and second tunnels being aligned along their longitudinal axis and disposed on opposite sides of said cylinder and having their longitudinal axes perpendicular to the major axis of said cylinder, the distant ends of said first and second tunnels each having a plunger therein for forcing said insulative material contained in said first and second tunnels towards said mold, the adjacent ends of said first and second tunnels being contoured to the largest radial excursion of said mold.

* * * * *

UNITED STATES PATENT AND TRADEMARK OFFICE

CERTIFICATE OF CORRECTION

PATENT NO. : 4,712,604

DATED : December 15, 1987

INVENTOR(S) : Thomas F. Sawyer

It is certified that error appears in the above-identified patent and that said Letters Patent is hereby corrected as shown below:

In column 2, at line 12, the word "discloses" should read --disclose--.

In column 4, at line 32, the word "portion" should read --portions--.

In column 4, at line 59, the word "Chemicl" should read --Chemical--.

In column 6, at line 37, the word "axis" should read --axes--.

Signed and Sealed this

Second Day of August, 1988

*Attest:*

DONALD J. QUIGG

*Attesting Officer*

*Commissioner of Patents and Trademarks*